United States Patent [19]

Vitale

[11] 4,367,625

[45] Jan. 11, 1983

[54] STIRLING ENGINE WITH PARALLEL FLOW HEAT EXCHANGERS

[75] Inventor: Nicholas G. Vitale, Schenectady, N.Y.

[73] Assignee: Mechanical Technology Incorporated, Latham, N.Y.

[21] Appl. No.: 246,879

[22] Filed: Mar. 23, 1981

[51] Int. Cl.[3] ..... F02G 1/04

[52] U.S. Cl. ..... 60/517; 60/520; 60/526

[58] Field of Search ..... 60/517, 520, 524, 526

[56] References Cited

U.S. PATENT DOCUMENTS 3,355,882 12/1967 Kohler et al. ..... 60/526

3,767,325 10/1973 Schuman ..... 60/520

3,828,558 8/1974 Beale ..... 60/520

*Primary Examiner*—Allen M. Ostrager

*Attorney, Agent, or Firm*—Joseph V. Claeys; Arthur N. Trausch, III

[57] ABSTRACT

A heat exchanger system for a Stirling engine includes a heater connected to the expansion space by a pair of parallel flow ducts, and a cooler connected to the compression space by a pair of parallel flow ducts. A circulator is arranged in one of the heater ducts and one of the cooler ducts to continuously circulate working fluid from the working space, through the heat exchanger, and back into the same working space. The expansion and compression processes are thereby made more isothermal and the heat exchangers may be made smaller, more effective and with a lower pressure drop.

11 Claims, 4 Drawing Figures

Fig. 1
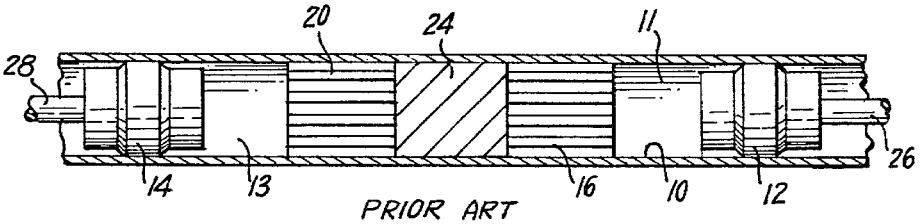
PRIOR ART
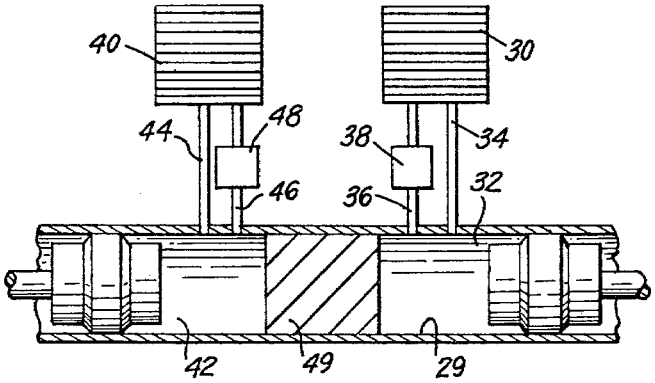
Fig. 2

STIRLING ENGINE WITH PARALLEL FLOW HEAT EXCHANGERS

BACKGROUND OF THE INVENTION

This invention relates to heat exchangers for a Stirling engine and more particularly to parallel flow heat exchangers for isothermalizing the expansion and compression spaces of the Stirling engine.

The ideal Stirling cycle is based on isothermal compression, constant volume heating, isothermal expansion, and constant volume cooling. This theoretical thermodynamic cycle is equal in efficiency to the theoretical Carnot cycle. However, there are numerous aspects of a practical Stirling cycle engine which cause its thermodynamic cycle to deviate from the classical theoretical Stirling cycle, with corresponding reductions in thermal efficiency. For example, the motion of the pistons is usually sinusoidal and therefore the P-V diagram is more oval than the curved parallelogram shape of the classical Stirling cycle P-V diagram. Other deviations from the classic Stirling thermodynamic cycle are introduced by frictional losses in the machine, gas leakage losses around the piston, and windage losses associated with gas flow through the heat exchangers.

One of the most serious deviations of practical engines from the Stirling cycle is a tendancy for the thermodynamic process in the expansion and the compression volumes to be adiabatic rather than isothermal. This results in part because the series arrangement of the heat exchangers causes the gas in the compression volume to be thermally isolated from the cold side heat exchanger, and causes the gas in the expansion volume to be thermally isolated from the hot side heat exchanger. Thus, as the gas expands or is compressed in the expansion or compression chambers, it does so in a gas volume which has already passed through the heat exchanger and is in effect insulated from heat exchange surfaces. Although the walls of the expansion space and compression space are at substantially the expansion and compression temperatures, they do not constitute effective heat exchangers with the gas in the expansion and compression chambers because of the very small surface area to volume ratio. Thus, the gas expanding in the expansion chamber tends to decrease in temperature, and the gas being compressed in the compression chamber tends to increase in temperature. These deviations from the classical Stirling cycle produce degradations in the classical Stirling cycle efficiency.

Another problem with the Stirling engine is associated with the critical length of the series heat exchangers in a reciprocating gas stream. The heat exchange properties between a hot or a cold surface and a gas is a function of the surface to volume ratio and the temperature differential between the heated surface and the gas. To provide a optimum heat transfer, it is necessary to make the gas flow passages very narrow or very long, thereby giving a high surface-to-volume ratio. However, these configurations result in high pressure drops across the heat exchangers, or excessive dead volume. Practical heat exchanger design normally results in a trade-off between the fluid pressure drop across the heat exchanger, the dead volume, and the effective heat exchange, resulting in less than desired performance in all respects.

A piston-displacer Stirling engine normally provides a gas flow path through external heat exchangers and an external regenerator. If the requirements of circulation through an external heat exchanger were not present, however, it would be possible to use a regenerator contained in the displacer which is an ideal use of the displacer volume and minimizes heat loss from the gas circuit. However, a regenerator-in-displacer configuration normally results in low efficiency because the heat exchangers on the two sides of the regenerator are normally in the expansion and compression spaces resulting in poor heat exchange.

SUMMARY OF THE INVENTION

Accordingly, it is an object of this invention to provide a system of heat exchangers for a Stirling engine which make the expansion and compression volumes more isothermal. In addition, the critical length of the heat exchangers designed for particular values of volume flow rate, temperature, and pressure drop across the heat exchanger, can now be designed for minimal pressure drops and high volumetric flow rates through the heat exchanger without requiring excessive temperatures in the heat exchangers and while retaining effective heat exchange. An additional object of the invention is to provide a displacer-piston Stirling engine having a regenerator in the displacer and operating with high efficiency.

These and other objects of the invention are achieved in the preferred embodiment wherein the Stirling engine heater is connected to the expansion space by parallel conduits and the working gas is continuously circulated from the expansion volume to the heat exchanger and back into the expansion volume so that the expansion process tends to be isothermal rather than adiabatic. A similar parallel flow heat exchanger and circulator is provided for the cooler so that the Stirling cycle compression process is likewise more isothermal than adiabatic. In piston-displacer engines, the invention permits the use of a regenerator in the displacer because of the highly effective heat exchange process.

DESCRIPTION OF THE DRAWING

The invention and its many attendant objects and advantages will become better understood upon reading the following detailed description of the preferred embodiments in conjunction with the following drawings, wherein:

FIG. 1 is a schematic diagram of a prior art Stirling engine;

FIG. 2 is a schematic diagram of a Stirling engine incorporating parallel flow heat exchangers according to this invention;

DESCRIPTION OF THE PREFERRED EMBODIMENT

Figure 3:
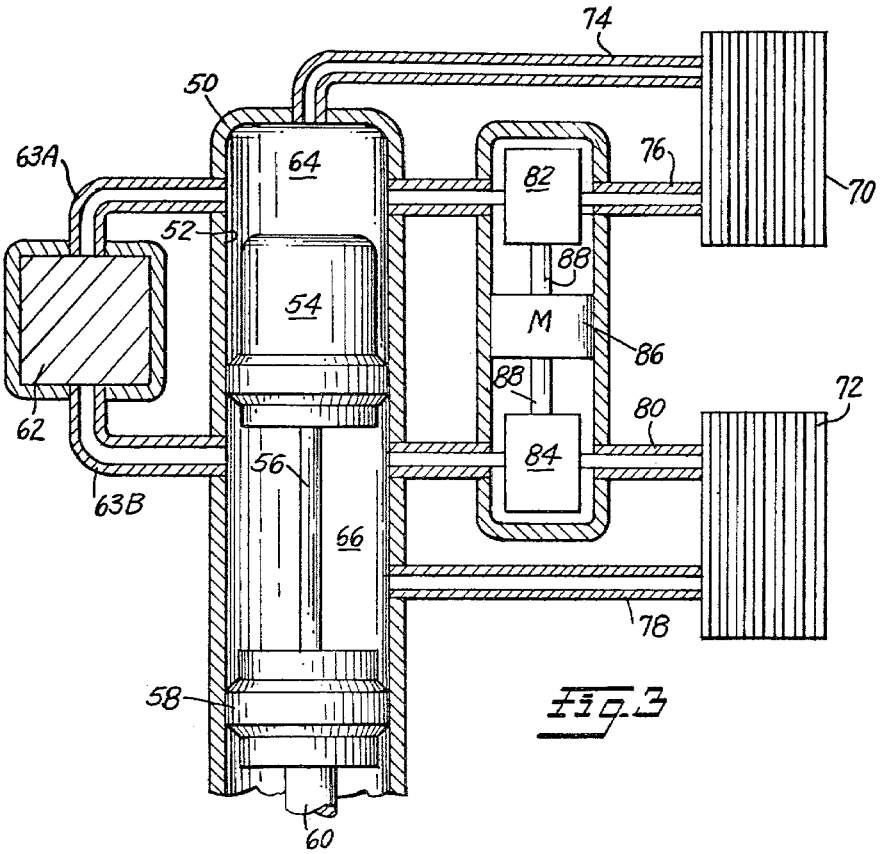
FIG. 3 is a piston-displacer Stirling engine incorporating parallel flow heat exchangers according to this invention.

Turning now to the drawings, wherein like reference characters designate identical parts, and more particularly to FIG. 1 thereof, a prior art Stirling engine is shown having a cylinder 10 having defined therein a working space including an expansion space 11 in which reciprocates a displacer 12 which causes the volume of the expansion space to vary periodically, and a compression space 13 in which reciprocates a power piston 14 which causes the volume of the compression space to vary periodically, lagging the expansion space volume by 90°. The two portions 11 and 13 of the working space could be separate cylinders or connected together forming a single cylinder. The working space in the cylinder 10 is filled with a working gas such as hydrogen or helium under pressure. A hot heat exchanger or heater 16 is provided for heating the working gas as it passes into the expansion space 11 and a cold heat exchanger or cooler 20 is provided for cooling the gas flow into the compression space 13. A regenerator 24 is disposed between the heat exchangers for storing heat as the working gas flows from the expansion space 11 toward the compression space 13, and for releasing the stored heat back to the working gas as it flows from the compression space 13 towards the expansion space 11. In this way, a large quantity of heat is saved which otherwise would be absorbed by the cooler 20.

In operation, the displacer 12 is caused to oscillate in the expansion space, for example by the piston rod 26. The pressure wave created in the working space when the displacer 12 moves away from the piston 14 and the working gas expands through the heater 16 into the expansion space 11 drives the power piston away from the displacer to create output power which is transmitted through the power piston rod 28. The power piston oscillates with a lagging relationship of about 90° to the displacer so that on its return stroke, the displacer 12 has displaced most of the working gas through the regenerator 24 and cooler 20 into the compression space 13 where it is compressed by the piston 14 moving into the compression space.

The compression and expansion processes normally cause a rise and fall respectively of the temperature of the gas in the course of the process. Ideally, the Stirling cycle extracts and adds heat during the compression and expansion processes so that the temperature is constant, that is, the process is isothermal. However, heat exchange in the working space requires intimate contact of the gas with a heat exchanger surface. Since the normal series arrangement of heat exchangers in the conventional Stirling engine effectively insulates the gas in the compression and expansion volume from the cooler and heater, respectively, the actual compression and expansion processes are closer to adiabatic than isothermal. The resulting deviation from the ideal Stirling cycle results in a lowering of efficiency.

Turning now to FIG. 2, a Stirling engine of the same type as shown in FIG. 1 is shown incorporating a pair of parallel flow heat exchangers including a heater and a cooler connected to a cylinder 29. The heater 30 is connected to an expansion space 32 within the cylinder 29 by a pair of conduits 34 and 36 through which working gas can be circulated in a continuous circulation path from the expansion space 32, through the conduit 34 and into the heater 30 where it is raised in temperature to the temperature of the heater thereby compensating for the dropping temperature of the gas as it expands in the expansion space. The gas is circulated by a blower 38 in the return conduit 36 which maintains continuous circulation between the heater 30 and expansion volume 32.

The cooler 40 is connected in parallel to a compression space 42 in the cylinder 29 by a pair of gas flow conduits 44 and 46. A blower 48 is disposed in the return conduit 46 for continuous circulation of the working gas from the compression space 42 through the conduit 44 and the cooler 40, then back through the conduit 46 into the compression space to remove heat that is added to the gas as it is compressed so that the compression process is made more isothermal.

The invention thus accomplishes what has heretofore been impossible in the series heat exchanger Stirling engines by permitting a continuous circulation of the gas in the compression and expansion spaces through their respective heat exchangers so that the expansion and compression processes are closer to isothermal than adiabatic.

Another advantage of the invention is the elimination of the critical length phenomenon of heat exchangers in series flow arrangements. In the prior art configuration shown in FIG. 1, the entire heat exchange process must occur in one pass of the gas through the heat exchanger. This requires that a sufficient quantity of gas must pass in close proximity to a hot or cold surface, and that the temperature change of the gas be according to the engine specification. The practical constraints on the heat exchanger are related to its size, temperature, surface area of heat exchanger surfaces, pressure drop, and the dead volume it introduces between the expansion and compression spaces. These requirements impose conflicting design constraints on the heat exchanger and as a result are normally subject to engineering trade-offs which result in less than ideal performance characteristics.

This invention enables the use of a heat exchanger that is smaller than the conventional heat exchangers in Stirling engines, and imposes a lower pressure drop between the expansion and compression spaces. Indeed, the only pressure drop existing between the expansion and compression spaces with the use of this invention is the pressure drop across the regenerator 49. The power necessary to force gas circulation through the heater 30 and the cooler 40 is, to some extent, a drain on the engine power as an auxiliary function, but it does not occur in the thermodynamic cycle and therefore the cumulative effect of the power loss is not imposed on the system until the accessory drive take-off from the driveshaft, and therefore its effect on the overall engine system is less than that imposed by conventional heat exchangers even though the actual viscous losses in the heat exchanger of this invention may be as high or even somewhat higher in absolute terms.

Turning now to FIG. 3, a piston-displacer Stirling engine is shown having a vessel or engine block 50 having formed therein a cylinder 52 in which oscillates a displacer 54 driven by a piston rod 56. A piston 58 also oscillates in the cylinder 52 and transmits power to a load through piston rod 60. Conveniently, the piston rod 56 of the displacer 54 passes concentrically through the piston rod 60 of the power piston 58.

A regenerator 62 is connected by gas lines 63A and 63B between the expansion space 64 above the displacer 54 and the compression space 66 between the power piston 58 and the displacer 54. The regenerator 62 performs the usual function of extracting heat from the working gas as it flows from the expansion space 64 through the regenerator 62 into the compression space 66, and releasing the stored heat to the working gas as it flows through the regenerator 62 back into the expansion space 64.

A pair of heat exchangers including a heater 70 and a cooler 72 are connected in parallel to the expansion and compression spaces, respectively, by parallel gas conduits. The heater 70 is connected to the expansion space 64 by gas conduits 74 and 76 which enable the working gas in the expansion space 64 to be circulated continuously from the expansion space, through the heater 70, and back into the expansion space. Likewise, the cooler 72 is connected by parallel gas conduits 78 and 80 to the compression space 66 so that the gas in the compression space can be continuously circulated from the compression space through the cooler 72, and back into the compression space.

The circulation of the working gas is accomplished by a pair of gas impellers 82 and 84 in the gas conduits 76 and 80, respectively. The impellers are driven by a single drive means such as an electric motor 86 connected to both impellers by a short drive rod 88. The impeller 82 in the hot gas circuit is of high temperature material such as Inconel X750 or Alpha Silicon Carbide, and thermal insulation is provided in the shaft 88 between the impeller 82 and the motor 86 to prevent heat from passing from the impeller through the shaft to the motor 86. In addition, the impeller 82 is provided with high temperature ceramic seals which prevent leakage of high temperature working gas from the impeller cavity to the motor 86. Gas leakage from the cavity of impeller 82 would constitute a leakage of heat directly from the heater to the cooler resulting in a lowering of thermal efficiency and would tend to increase the temperature of the motor 86. The low temperature impeller 84 can be of ordinary low temperature materials and the sealing of the impeller in its cavity can be of low temperature materials such as Teflon.

Since the working gas is circulated continuously through the heater 70 and cooler 72, the heating and cooling process is much more effective than the single pass heat exchanger because the gas is subjected to multiple passes through the heat exchangers. Therefore, the usual requirements that are necessary to achieve effective heat exchanger with the gas are greatly relaxed and the design flexibility is vastly increased. For example, if it is desired to reduce both the dead volume and pressure drop imposed by the heat exchanger, it can be made shorter and the gas passages can be made wider. The ineffectiveness that this would normally impose on the heat exchange process can be counteracted by the multiple passes of the working gas through the heat exchanger. If it is desired to decrease the temperature of the heater or increase the temperature of the cooler, this can also be accomplished by counteracting the slower rate of heat exchange which normally attend such a design change by increasing the number of passes through the working gas through the heat exchanger.

Figure 4:
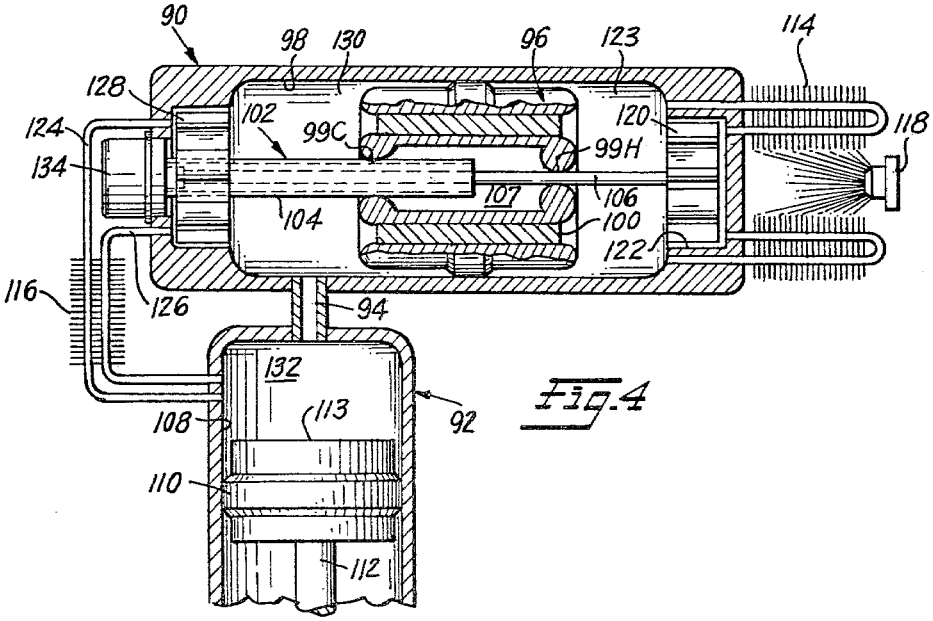
FIG. 4 is a Stirling engine of the Robinson variety incorporating parallel flow heat exchangers according to this invention.

Turning now to FIG. 4, a free piston Stirling engine of the Robinson variety is shown incorporating parallel flow heat exchangers according to this invention. The engine includes a pair of cylinders 90 and 92 connected at their ends by a gas passage 94. A displacer 96 oscillates in a cylinder 98 formed within the vessel 90 and displaces working gas through an annular regenerator 100 contained within the displacer 96. The displacer 96 is a free piston displacer mounted with sliding seals 99H and 99C on a stationary rod 102 having a wide diameter portion 104 and a narrow diameter portion 106. The effective differential areas of the displacer end faces, which the different cross sectional areas of the rod sections 104 and 106 produce, provide a force imbalance which, in conjunction with a gas spring, maintain the displacer 96 in motion. The gas spring includes a gas spring chamber 107 within the displacer 96 coacting with the rod 102 whose wide diameter portion 104 acts to compress the gas within the chamber 107 when the displacer moves into the cold end 130 of the working space. The gas pressure force acting on the interior end faces of the chamber 107 is greater on the larger interior face of the chamber hot end than at the chamber cold end, resulting in a differential force tending to move the displacer toward the hot end 123 of the working space when the displacer is in the cold end 130.

The vessel 92 has defined therein a cylinder 108 in which oscillates a power piston 110. A piston rod 112 is connected to piston 110 for transmitting power to an external load. The face 113 of the piston 110 constitutes a movable wall bounding the working space that is movable into the compression space to compress working gas contained therein during the compression phase of the Stirling cycle, and is movable in the opposite direction during the expansion phase of the Stirling cycle to transmit output power to the load through the piston rod 112.

A heater 114 is connected to the vessel 90 at one end, and a cooler 116 is connected to the vessels 90 and 92 at the other end. The heater 114 exchanges heat between combustion gases from a combustor 118 and a pressurized working gas which circulates through a set of finned heater pipes which make up the heater 114. The working gas is circulated continuously through the heater pipes by a blower impeller 120 mounted in an impeller cavity 122. The heater pipes of the heater 114 are each in the form of a loop; the impeller cavity is connected to one leg of the loop, and the other leg is connected to expansion space 123 of the cylinder 98 between the front end of the displacer 96 and the front end of the cylinder 98. The working fluid is continuously circulated from the expansion space 123, through the heater pipes of the heater 114 and back to the expansion space thereby maintaining the working gas in the expansion space at the isothermal design temperature of the engine despite the temperature drop that would normally be experienced as a result of the gas expanding in the expansion.

The cooler 116 is connected between the cylinder 98 and the cylinder 108. It includes a parallel set of gas flow conduits 124 and 126 which enable continuous circulation of working gas between the two portions of the engine compression space, that is a top portion 130 between the displacer 96 and the rear or cold end of the cylinder 98, and a lower portion 132 between the top face 113 of the power piston 110 and the top of the cylinder 108. The gas is continuously circulated by a circulator impeller 128 which causes the gas to circulate continuously from the top portion 130 of the compression space to the lower portion 132 of the compression space and back again. In this way, the compression space is maintained at its designed isothermal temperature.

A motor 134 is mounted adjacent the compression space top portion 130 and drives the impeller 128 directly. The shaft 106 is also connected to the motor and extends through the large diameter shaft 104 to the impeller 120 which it drives. In this way, the shafts 104 and 106 serve the quadruple functions of creating an area differential between the outside front and rear faces of the displacer 96, functioning as a displacer centering and support rod, driving the hot end impeller 120, and coacting with the gas spring chamber 107 to form a displacer gas spring.

The invention thus enables the thermodynamic processes in the expansion and compression volumes of a Stirling engine to more closely approximate the ideal isothermal processes of the theoretical Stirling cycle than the conventional series heat exchangers. The result is an improvement in cycle efficiency and a reduction in heat exchanger pressure drop, maximum temperature, size, cost, volume, and weight. Moreover, the heat exchanger effectiveness is independent of piston displacement so that the heat exchanger according to this invention is ideally suited for Stirling engines having power control achieved by piston stroke variation. In addition, the parallel flow arrangement of the gas in the compression and expansion volumes through their respective heat exchangers facilitates the use of the regenerator-in-displacer engine configuration without the loss in efficiency which that design configuration normally imposes on the engine.

Obviously, numerous modifications and variations of the particular embodiments disclosed herein will occur to those skilled in the art in light of this disclosure. Accordingly, it is expressly to be understood that these modifications and variations, and the equivalents thereof, may be practiced while remaining in the spirit of the invention as defined in the following claims, wherein

I claim:

1. A Stirling engine having at least one cylinder having a first piston mounted for reciprocation therein; an expansion space in said cylinder on one side of said piston; a regenerator having one side communicating with said expansion space; a compression space communicating with the other side of said regenerator; a second piston mounted for reciprocation in a second cylinder and communicating with said compression space; a gas heater in communication with said expansion space, and a gas cooler in communication with said compression space; wherein the improvement comprises:

a first circuit including a first set of parallel gas flow conduits connecting said gas heater to said expansion space, and first means for circulating working gas through said heater, through one of said conduits on one set, through said expansion space, through the other of said conduits on said one set, and back to said heater;

a second circuit including a second set of parallel gas flow conduits connecting said gas cooler to said compression space, and second means for circulating working gas through said cooler, through one of said conduits on the other set, through said compression space, through the other conduit on said other set, and back to said cooler;

whereby the thermodynamic process in each space tends to be isothermal and the critical length phenomenon is alleviated for improved cycle efficiency.

2. The Stirling engine defined in claim 1, wherein said first piston is a displacer, and wherein said second piston is a separate power piston, and wherein said regenerator is mounted in said first piston.

3. The Stirling engine defined in claim 1, wherein said first and second circulating means each includes a gas impeller disposed in said first and second circuit, respectively.

4. The Stirling engine defined in claim 3, wherein said first and second circulating means further includes a single drive means for driving both gas impellers.

5. A free piston Stirling engine having a working space, a free displacer mounted in said working space for oscillation therein and dividing said working space into an expansion space and a compression space; a movable wall bounding one end of said working space and movable into said compression space to compress working gas contained therein during the compression phase of the Stirling cycle, and movable away from said working space during the expansion phase of said Stirling cycle to transmit power; a heater for heating said working gas during said expansion phase, and a cooler for cooling said working gas during said compression phase; wherein the improvement comprises:

a first circulator for continuously circulating working gas in said expansion space through said heater;

a second circulator for continuously circulating working gas in said compression space through said cooler;

a regenerator disposed in said displacer for storing heat deposited by said working gas when said displacer moves toward said expansion space and displaces gas in said expansion space through said regenerator, and for restoring said heat to said working gas when said displacer moves back toward said compression space and displaces gas in said compression space through said regenerator.

6. The free piston Stirling engine defined in claim 5, wherein said first circulator includes an impeller in said expansion space, and said second circulator includes an impeller in said compression space.

7. The free piston Stirling engine defined in claim 6, wherein a single drive means is provided for rotating both impellers.

8. The free piston Stirling engine defined in claim 7, wherein said single drive means is disposed adjacent said compression space.

9. The free piston Stirling engine defined in claim 8, wherein said displacer is mounted on a post, and said post includes a driveshaft extending from said compression space to said expansion space impeller.

10. The free piston Stirling engine defined in claim 9, wherein said post includes a stationary large diameter portion extending from stationary mounting structure in said compression space into the adjacent end of said displacer, and a driveshaft extending from said drive means telescopically through said large diameter portion and therebeyond, through said displacer to said expansion space impeller.

11. A free piston Stirling engine having a working space, a free displacer mounted in said working space for axial oscillation therein and having axially facing front and rear faces which divide said working space into an expansion space and a compression space; a movable wall bounding one end of said working space and movable into said compression space to compress working gas contained therein during the compression phase of the Stirling cycle, and movable away from said working space during the expansion phase of said Stirling cycle to transmit power; a heater for heating said working gas during said expansion phase, and a cooler for cooling said working gas during said compression phase; wherein the improvement comprises:

an annular regenerator disposed in said displacer for storing heat deposited by said working gas when said displacer moves toward said expansion space and displaces gas in said expansion space through said regenerator, and for restoring said heat to said working gas when said displacer moves back toward said compression space and displaces gas in said compression space through said regenerator;

means in said regenerator defining a central cavity therein;

a small diameter axial hole extending from said cavity and opening in the front face of said displacer;

a larger diameter axial hole extending from said cavity and opening in the rear face of said displacer;

an axially extending post mounted in said working space and extending through said axial holes, said post including a large diameter portion extending through said large diameter hole, and a small diameter portion extending through said small diameter hole;

said post differential diameters reducing the effective face area of said rear face relative to said front face, and effectively reducing the interior rear face of said cavity relative to the interior front face of said cavity so that the oscillation of said displacer is maintained by the differential pressure forces exerted on said displacer by the pressure wave in said working space created by the Stirling cycle.

* * * * *